US008613535B2

(12) United States Patent
Suzuki

(10) Patent No.: US 8,613,535 B2
(45) Date of Patent: Dec. 24, 2013

(54) WIDE LIGHT REGION LAMP FOR VEHICLE

(75) Inventor: Hiroshi Suzuki, Yokohama (JP)

(73) Assignees: Hyundai Motor Japan R&D Center Inc., Yokohama (JP); Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/611,385

(22) Filed: Sep. 12, 2012

(65) Prior Publication Data

US 2013/0229816 A1 Sep. 5, 2013

(30) Foreign Application Priority Data

Mar. 2, 2012 (JP) ..... 2012-47214

(51) Int. Cl.
*F21V 7/04* (2006.01)

(52) U.S. Cl.
USPC ..... 362/516; 362/488

(58) Field of Classification Search
USPC ..... 362/471, 478, 488, 516
See application file for complete search history.

(56) References Cited

U.S. PATENT DOCUMENTS

| | | | | |
|---|---|---|---|---|
| 3,685,912 | A | 8/1972 | Graig | |
| 5,667,736 | A | 9/1997 | Chien | |
| 6,812,822 | B1 | 11/2004 | Spector | |
| 7,338,184 | B2 | 3/2008 | Chen et al. | |
| 7,540,106 | B2 | 6/2009 | Weiss | |
| 7,731,388 | B2 | 6/2010 | Hoelen et al. | |
| 7,891,844 | B2 | 2/2011 | Schug et al. | |
| 7,980,711 | B2 | 7/2011 | Takayanagi et al. | |
| 8,210,717 | B2 | 7/2012 | Medendorp, Jr. et al. | |
| 8,475,020 | B2 | 7/2013 | Dubosc | |
| 2003/0067784 | A1* | 4/2003 | Erber | 362/516 |
| 2006/0203484 | A1 | 9/2006 | Yu | |
| 2009/0016063 | A1 | 1/2009 | Hu | |

FOREIGN PATENT DOCUMENTS

| | | | |
|---|---|---|---|
| EP | 1 835 225 | A1 | 9/2007 |
| JP | 11-317104 | A | 11/1999 |
| JP | 2002-75018 | A | 3/2002 |
| JP | 2002-196108 | A | 7/2002 |
| JP | 2003-66873 | A | 3/2003 |
| JP | 2003-323805 | A | 11/2003 |
| JP | 2009-87596 | A | 4/2009 |
| KR | 10-2009-0082615 | A | 7/2009 |
| KR | 10-0986400 | B1 | 10/2010 |
| KR | 10-2011-0116891 | A | 10/2011 |

* cited by examiner

*Primary Examiner* — David V Bruce
(74) *Attorney, Agent, or Firm* — Morgan, Lewis & Bockius LLP

(57) ABSTRACT

A wide light region lamp apparatus for a vehicle wherein a light emitting region thereof may be increased by covering a point light source with a patterned cover may include a semi-spherical reflective surface on which a mirror surface may be processed, the point light source mounted to a center of the reflective surface, and a three-dimensional cover configured to cover the point light source.

8 Claims, 7 Drawing Sheets

(a) STRAIGHT COVER (WHEN NOT TURNED ON)

(b) PERSPECTIVE VIEW (WHEN NOT TURNED ON)

(c) SMOOTHLY CURVED COVER (WHEN NOT TURNED ON)

(a) STRAIGHT COVER (WHEN TURNED ON)

(b) PERSPECTIVE VIEW (WHEN TURNED ON)

(c) SMOOTHLY CURVED COVER (WHEN TURNED ON)

WIDE LIGHT REGION LAMP FOR VEHICLE

CROSS-REFERENCE TO RELATED APPLICATIONS

The present application claims priority to Japanese Patent Application No. 2012-47214 filed in the Japanese Patent Office on Mar. 2, 2012, the entire contents of which is incorporated herein for all purposes by this reference.

FIELD OF THE INVENTION

The present invention relates to relates to a wide light region lamp for a vehicle. More particularly, the present invention relates to a wide light region lamp for a vehicle which can enlarge a light emitting area thereof with a small number of point light sources.

DESCRIPTION OF RELATED ART

Light emitting diodes (LEDs) are applied to traffic signals, mobile phones or home appliances, and are known as point light sources showing high luminance, long lifespan and directivity. In the field of vehicles, LEDs have been employed in a brake lamp, a daytime light, and the like and are being developed to be applied to a headlight.

If LEDs can be applied to a light source of a headlight, an improvement of lifespan of a lamp can be expected in addition to a merit of saving electric power. Moreover, LEDs have a merit of being bright from the very time when turned on.

In addition, LEDs can promote compactness of light sources, and it is one of the merits of the LEDs to increase a degree of design around a headlight.

However, LEDs are not suitable for a headlight due to an insufficient amount of light and the lighting angles thereof are small, which is undesirable. Accordingly, a plurality of LEDs, e.g., one hundred and several tens of LEDs are used for one vehicle as a measure for securing a sufficient amount of light.

FIG. 6 illustrates a headlamp 50 according to the related art, where 60 LED light sources for one headlamp 50 and thus 120 LED light sources for one vehicle are arranged to increase light emitting areas because lighting angles of LED light sources 1 are narrow.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a wide light region lamp for a vehicle which can enlarge a light emitting area thereof with a small number of point light sources.

A wide light region lamp apparatus for a vehicle wherein a light emitting region thereof is increased by covering a point light source with a patterned cover, may include a semispherical reflective surface on which a mirror surface is processed, the point light source mounted to a center of the reflective surface, and a three-dimensional cover configured to cover the point light source.

The three-dimensional cover may have gratings formed on an outer surface thereof.

The three-dimensional cover may have a flame-shaped outer appearance having longitudinal gratings, is formed of a reflective material, and may have a turbine blade-shaped cross-section when viewed from a direction of light progress.

The three-dimensional cover is formed in a cylinder and may include patterns formed on the cylinder.

The patterns are opaque.

The patterns are triangular, rectangular or in a shape of water drop.

The wide light region lamp apparatus may further include an additional semispherical reflective surface formed below the semispherical reflective surface.

A curvature of the additional semispherical reflective surface is larger than a curvature of the semispherical reflective surface.

According to the wide light region lamp for a vehicle of the present invention, a light emitting area thereof can be increased by irradiating lights from point light sources on a reflective surface thereof through a three-dimensional cover and the light emitting area thereof can be enlarged with a small number of point light sources as lights can be irradiated in an appealing shape.

Further, various patterns can be expressed through a combination of a shape of a reflective surface of a mirror surface and a three-dimensional pattern of a cover, thereby increasing a product value.

In addition, a combination of a reflective surface of a mirror surface and a three-dimensional cover three-dimensionally changes a pattern of lights viewed at an angle, thereby improving visibility of light sources.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIGS. 2A and 2C illustrate sections of the wide light region lamp for a vehicle according to an exemplary embodiment of the present invention viewed from a direction of light progress when the lamp is not turned on.

FIG. 2B is a perspective view illustrating the wide light region lamp for a vehicle according to an exemplary embodiment of the present invention when the lamp is not turned on.

FIG. 3 is a view illustrating a state of the wide light region lamp of FIG. 2 when the lamp is turned on.

Figure 1:
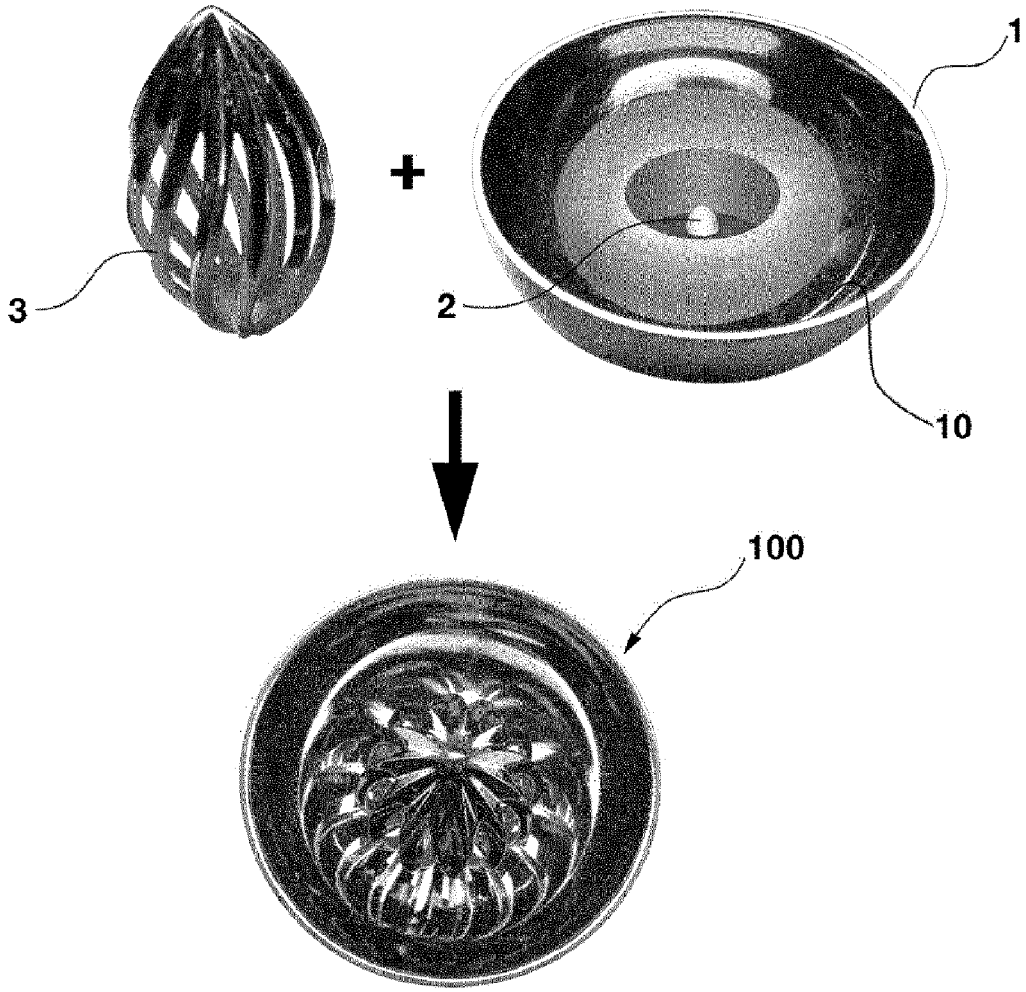
FIG. 1 is a view illustrating a configuration of a wide light region lamp for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The feature of the present invention lies in that a point light source is covered by a patterned cover and is a wide light region lamp for expanding a light emitting region thereof The wide light region lamp includes a semispherical reflective surface 1 on which a mirror surface is processed, a point light source 2 mounted to a center of the reflective surface 1, and a three-dimensional cover 3 covering the point light source 2.

The three-dimensional cover 3 has a flame-shaped outer appearance having longitudinal gratings, is formed of a reflective material, and has a turbine blade-shaped cross-section when viewed from a direction of light progress.

The point light source may be a small-sized incandescent lamp in addition to an LED.

Hereinafter, the wide light region lamp for a vehicle according to an exemplary embodiment of the present invention will be described in detail with reference to the accompanying drawings.

FIG. 1 is a view illustrating a configuration of the wide light region lamp for a vehicle according to an exemplary embodiment of the present invention. A wide light region lamp for a vehicle 100 is configured by combining an arm-shaped reflective surface 1 and a cover 3 which has a flame-shaped outer appearance having longitudinal gratings and is formed of a reflective material.

Figure 2:
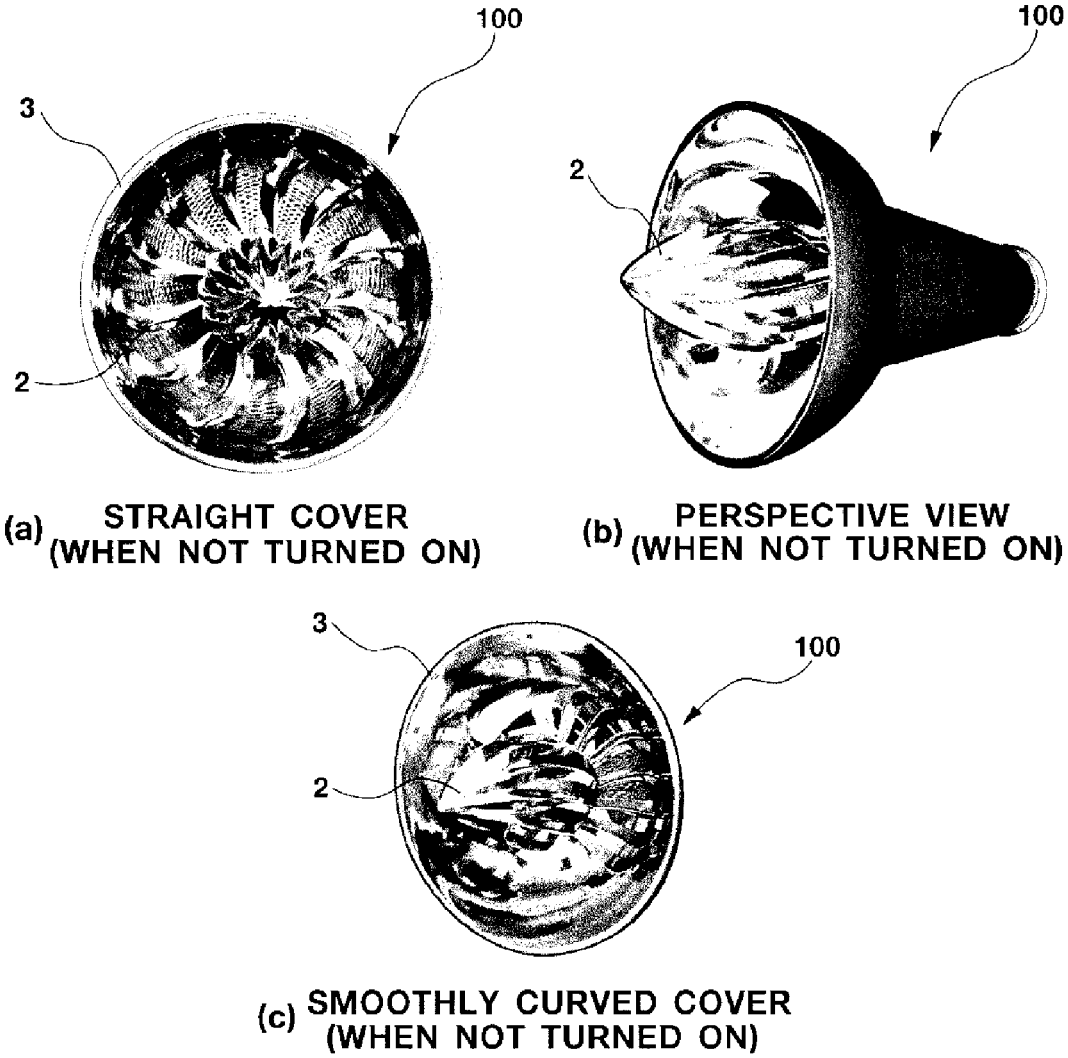

FIG. 2 illustrates forms of the wide light region lamp for a vehicle when the lamp is not turned on. FIGS. 2A and 2B illustrate a front view viewed from a direction of light progress when an apex of the flame-shaped outer appearance is located at a center of the arm-shaped reflective surface 1, and a perspective thereof, respectively. FIG. 2C illustrates a front view viewed from a direction of light progress when the flame-shaped outer appearance is displaced from the center of the arm-shaped reflective surface 1 as the flame-shaped outer appearance faces the apex.

Figure 3:
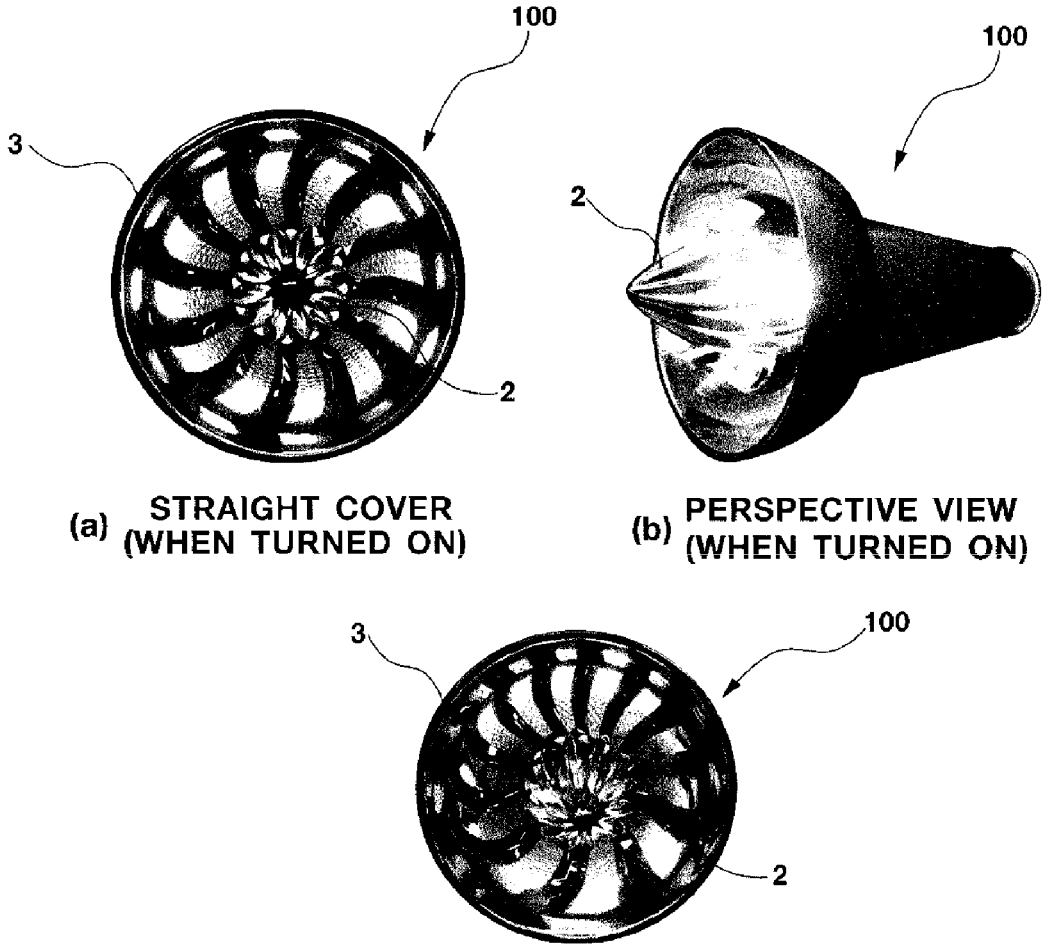
Figure 7:
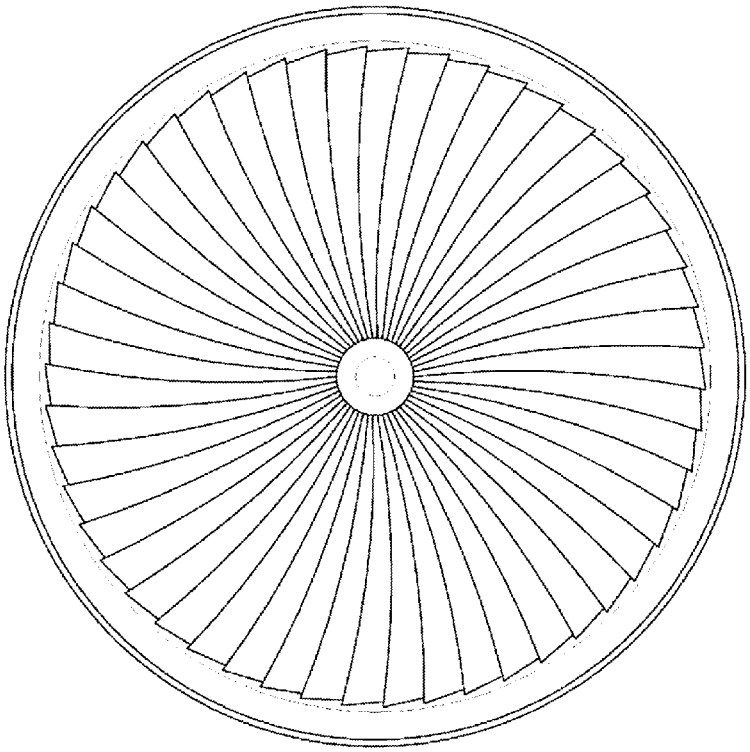
FIG. 7 is a view illustrating a cross-section of a turbine blade.

FIG. 3 illustrates that the wide light region lamp 100 for a vehicle of FIG. 2 is turned on, and a similar appealing pattern is clearly shown in the cross-section of a turbine blade of FIG. 7.

The three-dimensional cover 3 is configured by plating chrome on a surface of a metal or a resin to form a reflective body, in addition to transparent glass or a resin such as polycarbonate.

In the exemplary embodiment of the three-dimensional cover 3 has a flame-shaped outer appearance having longitudinal gratings, is formed of a reflective material, and has a turbine blade-shaped cross-section when viewed from a direction of light progress, but the present invention is not limited thereto.

Even if the outer appearance of the wide light region lamp has a flame shape, when the outer appearance of the wide light region lamp is displaced from the center of the arm-shaped reflective surface 1 as the flame-shaped outer appearance faces the apex, the outer appearance of the wide light region lamp may be formed as in FIG. 3C.

In an exemplary embodiment of the present invention, the wide light region lamp 100 may include an additional arm-shaped reflective surface 10 to form a duel reflective surface. The additional arm-shaped reflective surface 10 may be disposed below the arm-shaped reflective surface 1. The curvature of the additional arm-shaped reflective surface 10 is larger than that of the arm-shaped reflective surface 1.

The cross-section viewed from a direction of light progress may be freely changed according to a shape, a material and a pattern of the three-dimensional cover 3.

Figure 4:
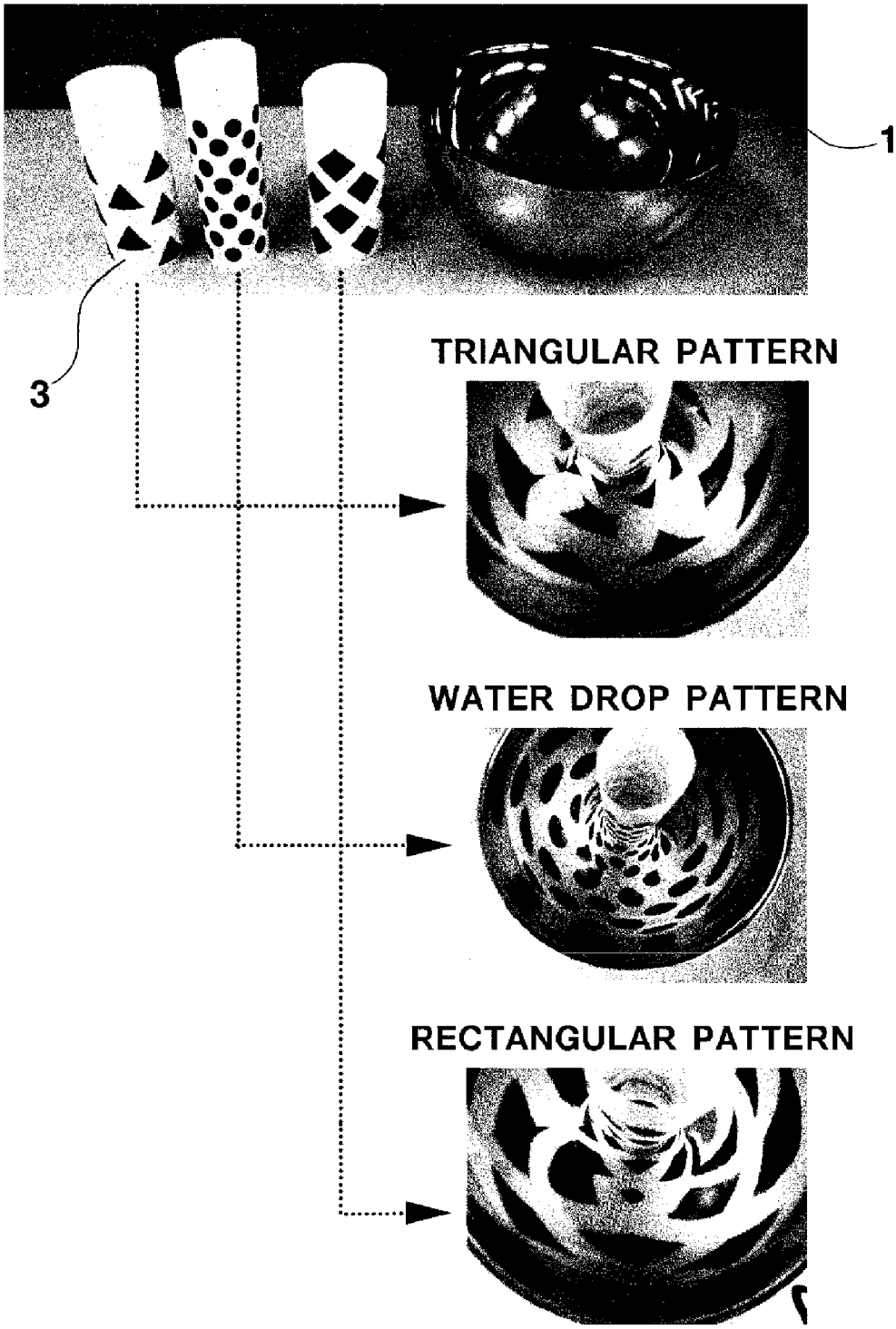
FIG. 4 is a view illustrating that cylindrical covers having triangular patterns, water drop patterns, and rectangular patterns are applied to the wide light region lamp for a vehicle according to an exemplary embodiment of the present invention.

For example, FIG. 4 illustrates another example of the three-dimensional cover 3, and a triangular pattern, a water drop pattern, and a rectangular pattern are applied to the cylindrical cover 3.

The combination of the body and pattern of the cylindrical cover 3 is not limited, but a transparent body may have a triangular, water drop, and rectangular opaque portion, or triangular, water drop, or rectangular holes may be formed in the body of the opaque cover 3 such that light passes through the holes.

Figure 5:
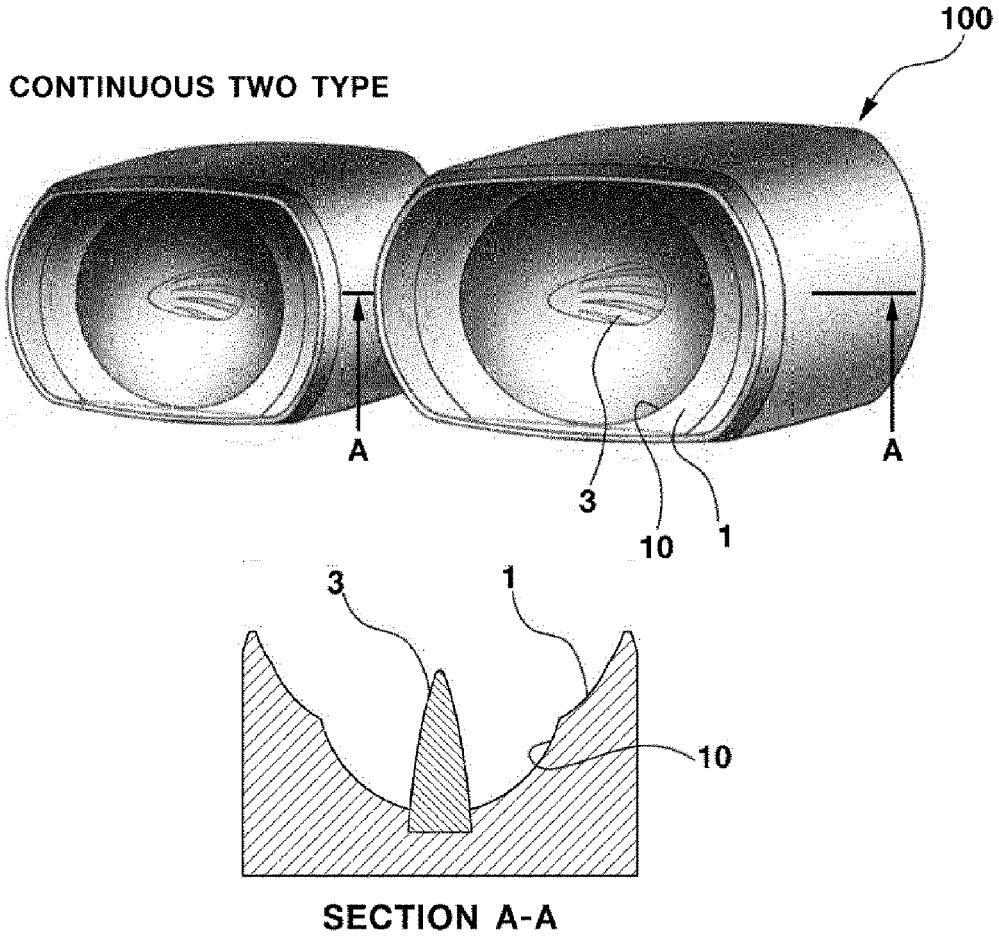
FIG. 5 is a view illustrating an example of installing two wide light region lamps for a vehicle according to an exemplary embodiment of the present invention.
Figure 6:
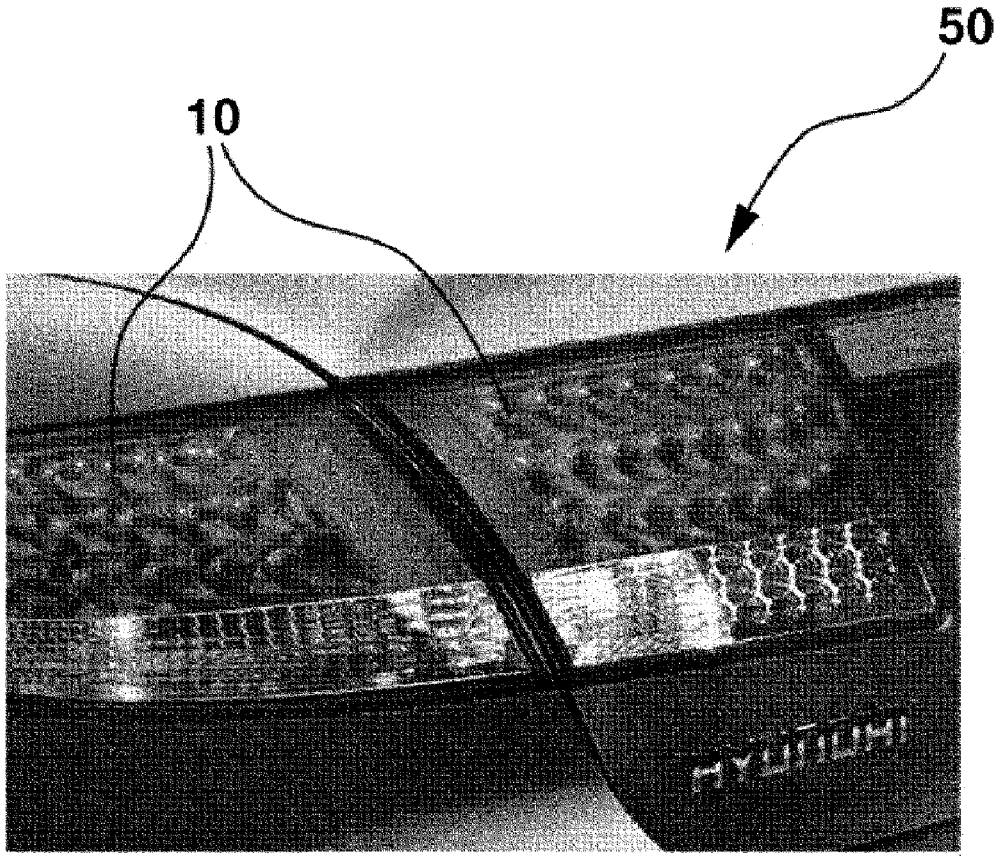
FIG. 6 is a view illustrating an example of an LED lamp according to the related art.

FIG. 5 illustrates an application example of the wide light region lamp 100 for a vehicle according to an exemplary embodiment of the present invention, and illustrates an example of arranging and installing two wide light region lamps which are mounted to a vehicle.

In this way, a plurality of wide light region lamps 100 for a vehicle may be freely installed together, and an appealing pattern can be formed by the cover 3 and a combination of arranging methods.

As described above, according to an exemplary embodiment of the present invention, a light emitting area of a wide light region lamp can be increased by irradiating light of a point light source on a reflective surface through a three-dimensional cover. Further, a light emitting area thereof can be enlarged with a small number of LEDs as lights can be irradiated in an appealing shape. In addition, various patterns can be expressed through a combination of a shape of a mirror reflective surface and a three-dimensional cover, thereby improving a product value.

The arrangement of a mirror reflective surface and a three-dimensional cover improves visibility of a light source to change a pattern of light according to a view angle in a three-dimensional way. The wide light region lamp according to the exemplary embodiment can be applied to not only a headlamp and a tail lamp but an interior illumination (furniture), or a traffic lamp, an electronic panel, and the like.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wide light region lamp apparatus for a vehicle wherein a light emitting region thereof is increased by covering a point light source with a patterned cover, the wide light region lamp apparatus comprising:

a semispherical reflective surface on which a mirror surface is processed;

the point light source mounted to a center of the reflective surface; and a three-dimensional cover configured to cover the point light source.

2. The wide light region lamp apparatus of claim 1, wherein the three-dimensional cover has gratings formed on an outer surface thereof.

3. The wide light region lamp apparatus of claim 1, wherein the three-dimensional cover has a flame-shaped outer appearance having longitudinal gratings, is formed of a reflective material, and has a turbine blade-shaped cross-section when viewed from a direction of light progress.

4. The wide light region lamp apparatus of claim 1, wherein the three-dimensional cover is formed in a cylinder and includes patterns formed on the cylinder.

5. The wide light region lamp apparatus of claim 4, wherein the patterns are opaque.

6. The wide light region lamp apparatus of claim 4, wherein the patterns are triangular, rectangular or in a shape of water drop.

7. The wide light region lamp apparatus of claim 1, further including an additional semispherical reflective surface formed below the semispherical reflective surface.

8. The wide light region lamp apparatus of claim 7, wherein a curvature of the additional semispherical reflective surface is larger than a curvature of the semispherical reflective surface.

* * * * *